US005598804A

United States Patent [19]

Vostitsanos

[11] Patent Number: 5,598,804

[45] Date of Patent: Feb. 4, 1997

[54] DEVICE FOR CLEARING WATER INTAKE GRILLES OF WATER JET WATERCRAFT

[76] Inventor: Lazaros J. Vostitsanos, 1432 Riverside Dr., Tarpon Springs, Fla. 34689

[21] Appl. No.: 523,688

[22] Filed: Sep. 5, 1995

[51] Int. Cl.[6] ..... B63B 59/00

[52] U.S. Cl. ..... 114/222; 440/46

[58] Field of Search ..... 114/222, 270, 114/221 R; 440/38, 46; 15/402, 1.7

[56] References Cited

U.S. PATENT DOCUMENTS

| | | | |
|---|---|---|---|
| 630,260 | 8/1899 | McLane | 114/222 |
| 646,357 | 3/1900 | Cook et al. | 114/222 |
| 1,063,804 | 6/1913 | Kindermann | 114/222 |
| 3,279,414 | 10/1966 | Rabald . | |
| 4,395,966 | 8/1983 | Murphy . | |
| 5,152,242 | 10/1992 | Bradley | 114/222 |
| 5,351,640 | 10/1994 | Attaway et al. | 14/222 |

FOREIGN PATENT DOCUMENTS

| | | | |
|---|---|---|---|
| 408695 | 1/1945 | Italy | 114/222 |

*Primary Examiner*—Stephen Avila

*Attorney, Agent, or Firm*—C. Douglas McDonald, Jr. & Associates, P.A.

[57] ABSTRACT

A device for clearing grilles covering water intake ports on watercraft whereby the grille may be easily cleared while remaining on or in the watercraft. The clearing device comprises at least one scraper that includes a base and a plurality of teeth extending outwardly from the base. A line is attached to the scraper and extends outwardly in opposing directions therefrom. By grasping one end of the line in each hand and looping the clearing device below the hull adjacent the grilles, the user moves the scraper back and forth across the grille so that the teeth grab the grasses and other materials pulling them free.

12 Claims, 2 Drawing Sheets

DEVICE FOR CLEARING WATER INTAKE GRILLES OF WATER JET WATERCRAFT

BACKGROUND OF THE INVENTION

1. Field of the Invention

The present invention relates to a device that is used to clear the protective grilles covering the water intake ports for water jet driven watercraft, more particularly, personal water vehicles, such as jet skis. The device permits one person to easily remove water grasses and other materials clogging the water pump intake grille without having to dismount from the water vehicle.

2. Description of the Prior Art

Watercraft that are propelled by a jet of water expelled from the stern of the vehicle require a water intake port to provide large quantities of water to the water propulsion pump. Lakes, streams, and other waterways collect floating grasses, leaves, alae, and trash, including paper and plastic. A grille is installed over the intake port in the hull of the watercraft to reduce the risk of sucking these floating materials into the interior of the pump, which, if permitted, would frequently result in serious damage to the pump. The strong suction of the water pump tangles these materials in the grille reducing the flow of water to the pump, which reduces the pump's efficiency and the speed at which the watercraft may travel. Often the grille becomes completely closed with such floating materials preventing any movement of the watercraft.

In most cases, the only method available for removal of the blockage is to jump from the watercraft into the water and remove by hand the grasses, etc. from the intake port. U.S. Pat. No. 3,279,414, issued to W. Rabaid discloses a complex apparatus that is to be installed in the interior of large watercraft. The apparatus has fingers that extend outwardly through the grille to free the grille from clogging materials. This method is cumbersome and requires complex machinery to be installed within the boat. Small boats, particularly jet skis, have little room to install such devices. Therefore, notwithstanding the existence of such prior art, it remains clear that there is a need for a device that will permit a single person to remove obstructions from water jet intake grilles without having to jump into the water to clear the grille by hand or without having to install a bulky device within the hull.

SUMMARY OF THE INVENTION

The present invention relates to a simple device for clearing the protective grilles of water jet intake ports on watercraft using water jet propulsion. The device removes most water grasses, trash, and other materials that are sucked against the grille and become tangled therein. Most simply stated, the clearing device comprises at least one scraper that comprises a base and a plurality of teeth that extend outwardly from the base. A line is attached to the scraper and extends outwardly in opposing directions therefrom. The user grasps one end of the line in each hand and loops the device under the watercraft so that the scraper rests against the grille covering the water intake port. The device is then moved back and forth across the water intake grille so that the teeth catch the grasses, papers, and other clogging materials removing them from the grille so that water may once again flow therethrough. More than one scraper may be mounted on the lines to improve the efficiency of the removal process.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
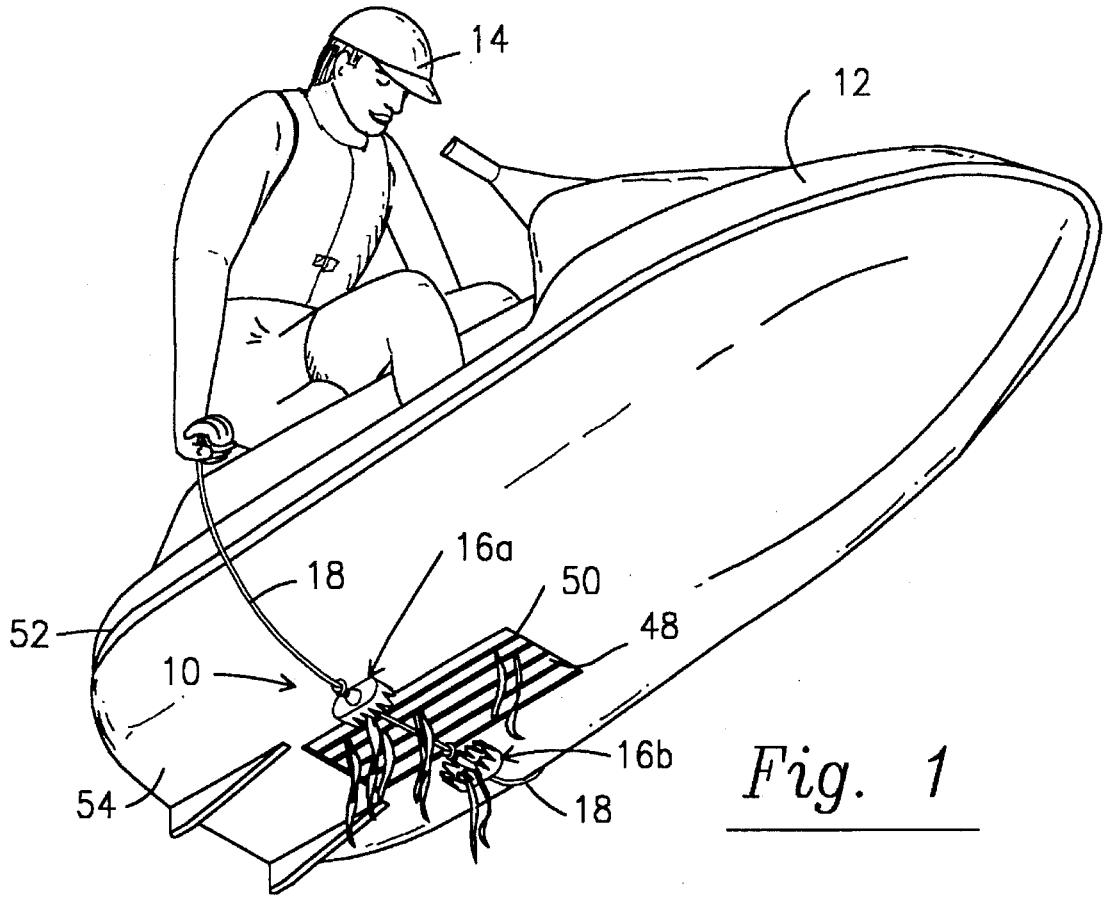
FIG. 1 is a perspective view of the clearing device of this invention, illustrating its use removing grasses from a jet ski intake port grille.
Figure 2:
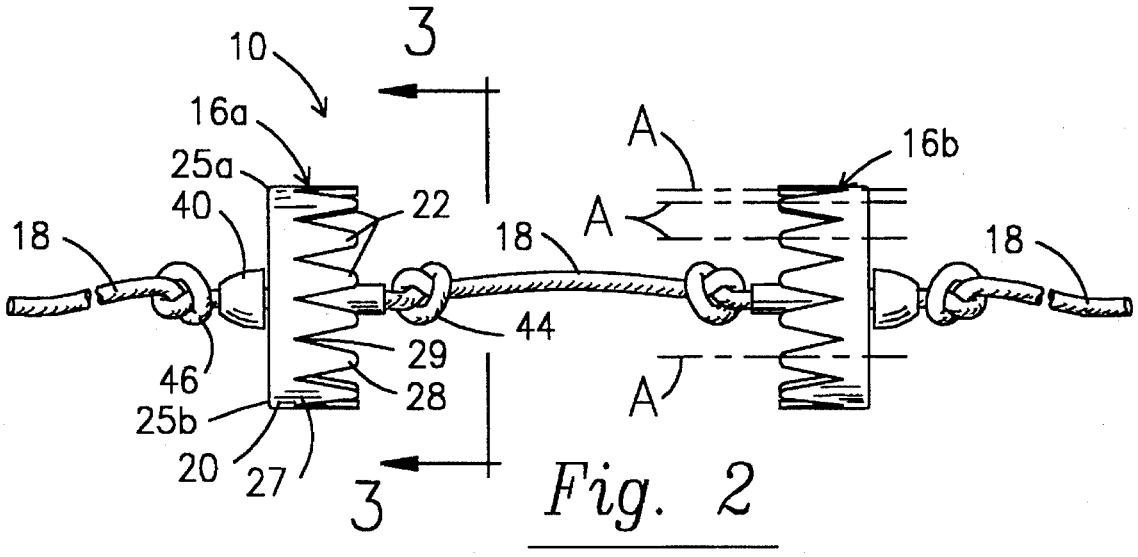
FIG. 2 is a plan view of the clearing device of this invention.

A preferred embodiment for the clearing device of this invention is illustrated in drawing FIGS. 1 and 2 in which the clearing device is generally indicated as 10. In FIG. 1, the watercraft is generally indicated as 12 and the user is indicated as 14.

Figure 3:
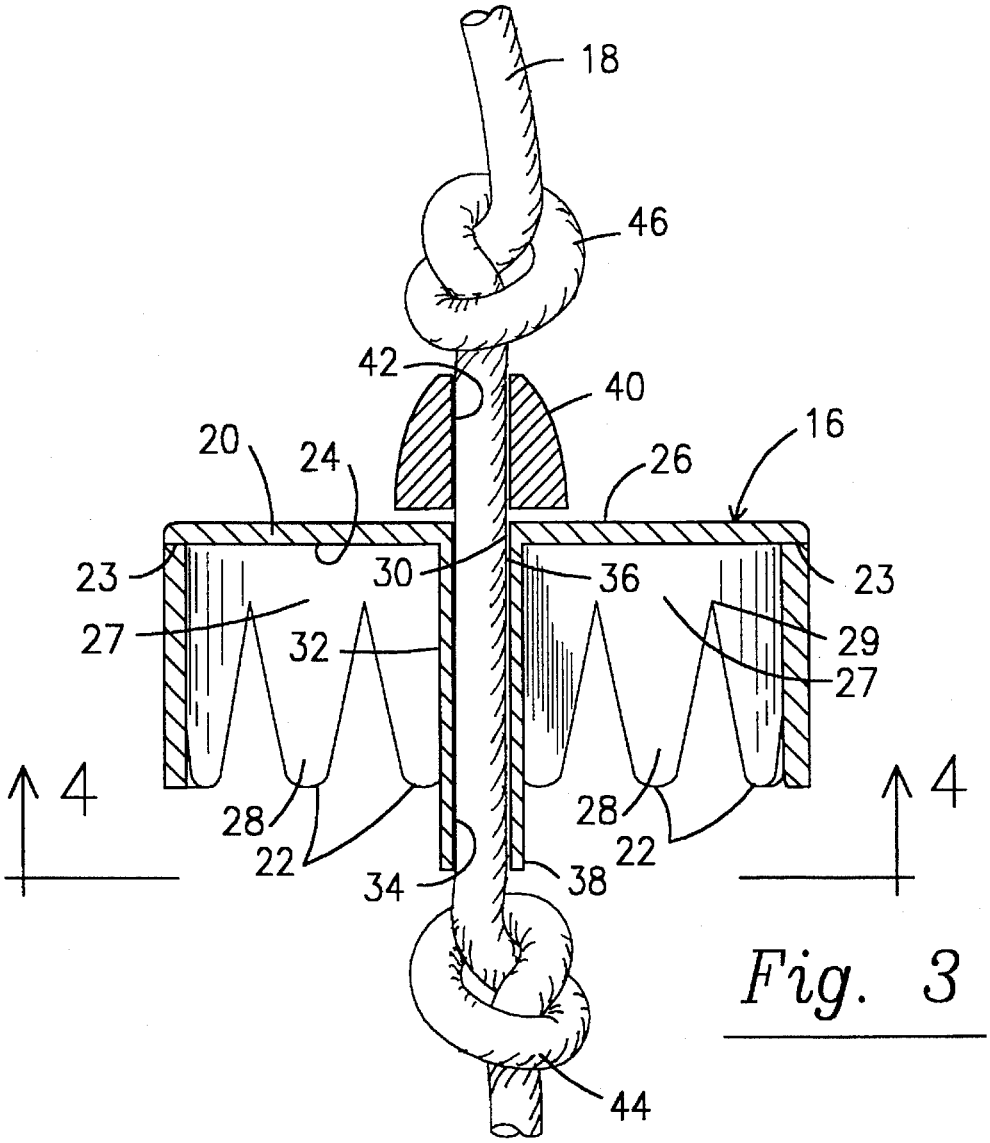
FIG. 3 is a detailed cross-sectional view taken along line 3—3 of FIG. 2.
Figure 4:
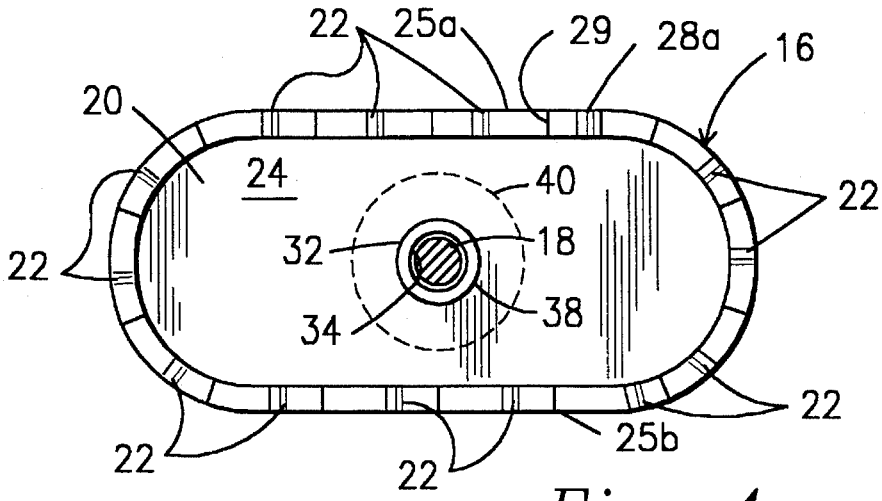
FIG. 4 is a detail view taken along line 4—4 of FIG. 3.

As can be seen in a preferred embodiment illustrated in FIG. 2, the clearing device 10 comprises at least one scraper shown generally as 16 and a line 18 attached to the scraper and extending in opposing directions therefrom. The scraper 16 comprises a base 20 and a plurality of teeth 22 that extend outwardly therefrom. As can be seen in FIGS. 1, 3, and 4, in the embodiment illustrated, the base 20 comprises a generally oval plate having a first side 24 and a second side 26. The base 20 has a peripheral edge shown generally as 23, and a port of the peripheral edge comprises a pair of generally parallel longitudinal edges 25*a* and 25*b* from which the teeth 22 project outwardly therefrom generally normal to the base 20. Each tooth 22 has a longitudinal axis A and since the teeth 22 are normal to the base 20 the axes A are generally parallel to one another. In the preferred embodiment illustrated in FIGS. 1–4 the plurality of teeth 22 are attached to the base 20 around the peripheral edge 23. The teeth 22 each have a first end 27 that is attached to the base 20 and a second end 28 that extends outwardly therefrom generally normal to the base 20. The teeth 22 are V-shaped as the second end 28 of each tooth is formed generally in a V-shape. The first ends 27 of adjacent teeth are attached to the base 20 so that a V-shaped groove 29 is formed between the teeth 22.

As seen in FIG. 3, the base portion 20 has a hole 30 therethrough. A post 32 has a bore 34 therethrough, and a first end 36 and a second end 38. The first end 36 of the post 32 is attached to the base 20 so that the bore 34 is aligned with the hole 30 through the base portion 20. The line 18 may then be threaded through the hole 30 in the base 20 and through the bore 34 of the post 32 so that the bore 34 captures line 18. In this manner the line adjacent the scraper 16 is protected from the teeth 22 of the scraper and the post provides assistance in maintaining the alignment of the teeth 22 of the scraper 16 in relation to the grille 48 of the watercraft 12. In other embodiments, the post 32 may be solid and extend beyond the teeth so that the line 18 may be divided into two parts with one part of the line 18 being captured by the end of the post and the other part of the line 18 being attached to the second side 26 of the scraper.

In order to add weight to the clearing device 10 so that it may easily sink below the watercraft 12, as illustrated in FIG. 1, a weight 40 is threaded upon the line 18 through a hole 42 that passes through the weight so that the weight lies adjacent the second side 26 of the scraper 16. To secure the scraper 16 and the weight 40 on the line 18, a knot 44 is tied in the line 18 adjacent the second end 38 of the post 32 and a second knot 46 is tied in the line 18 adjacent the weight 40 so that the weight lies against the second side of 26 of the scraper 16. Of course, other fastening means may be used to attach the line 18 to the scraper 16, including but not limited to hooks, clamps, and loops to which the line 18 may be tied; however, the knots 44 and 46 provide a simple and effective means for securing the scraper 16 and the weight 40 to the line 18.

In a preferred embodiment, a second scraper 16(*b*) is attached to the line 18 in the same manner as scraper 16(*a*). Scrapers 16(*a*) and 16(*b*) are positioned on the line 18 so that the teeth 22 oppose one another and the scrapers 16(*a*) and 16(*b*) are spaced generally 8 inches apart.

The base 20, the teeth 22 and the post 32 are preferably formed in a single integral unit from polyvinyl chloride. The line 18 is preferably a 12 foot piece of ¼ inch nylon. The weights 40 are formed from lead. Other embodiments of the scraper 16 may be comprised from other suitable materials including metals, such as aluminum or steel.

Having thus set forth a preferred construction for the clearing device 10 of this invention, it is to be remembered that this is but a preferred embodiment. Attention is now invited to a description of the clearing device 10. The clearing device 10 may be stored in a pouch to be carried on the watercraft, or may be stored in a compartment within the watercraft itself for easy access and use. During operation of the watercraft, conveniently a jet ski 12, as shown in FIG. 1, water is pulled through an intake port 48 to a pump (not shown) which then discharges the water out the stern at a high velocity and volume. If the volume of water being sucked through the intake port 48 is restricted, the outflow from the pump will be reduced slowing the watercraft. Lakes and waterways frequently contain floating grasses and other natural materials as well as floating trash that may include paper, plastic and other materials. To prevent these materials from being sucked into the pump, a grille 50 covers the intake port 48. During operation of the watercraft 12, the floating grasses and trash frequently become lodged and tangled within the intake grille 50 restricting the volume of water supplied to the pump, reducing the velocity and volume of the outflow, and thus slowing or stopping the watercraft 12, if the grasses and other materials completely close the intake port 48. The user 14 shuts the watercraft engine off and then removes the clearing device 10 from its storage place. While remaining seated on the watercraft 12, the user 14 grasps one end of the line 18 of the clearing device 10 in each hand and then drops the scrapers 16 over the stern 52 of the watercraft 12. The weights 40 cause the scrapers 16 to descend below the hull 54 of the watercraft 12 so that the user may position the clearing device 10 across the grille 50. The user 14 then takes up the slack in the line 18 so that the scraper 16 lies against the hull 54 and the grille 50. As the user 14 pulls the scrapers 16(*a*) and (*b*) back and forth across the grille 50, the teeth 22 grab the grasses and other materials caught within the grille 50 and pull the materials free unclogging the water intake port 48.

Without the clearing device 10, the user would have to return to land or would have to dismount from the jet ski 12 and manually pull the grass and other materials free from the grille 50. Once dismounted from the watercraft 12, it is very difficult and possibly dangerous to remount.

It will thus be seen that the objects set forth above, among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A boat hull scraper for clearing grilles covering water intake ports on watercraft, said clearing device comprising:

at least one scraper comprising a base having a pair of generally opposing longitudinal edges and a plurality of teeth, each tooth having a first end and a second end and an axis extending therethrough, and each tooth being attached to and extending outwardly from each edge of said pair of edges of said base, such that said axes of said plurality of teeth are generally parallel to one another; and a line attached to said scraper, said line extending outwardly in opposing directions therefrom.

2. A clearing device as in claim 1 wherein said scraper further comprises a post attached to said base and extending outwardly therefrom and said line being captured by said post.

3. A clearing device as in claim 2 wherein said post has a bore therethrough and said base has a hole therethrough, said post being attached to said base such that said bore is aligned in communication with said hole in said base such that said line passes through said bore of said post and said hole in said base, and said post extending outwardly from said base.

4. A clearing device as in claim 2 wherein said post extends generally parallel to said plurality of teeth.

5. A clearing device as in claim 2 wherein said base has a first side, said teeth and said post extending from said first side.

6. A clearing device as in claim 1 further comprising a weight attached to said line proximal said scraper.

7. A clearing device as in claim 1 wherein said teeth of said plurality of teeth are V-shaped, each tooth of said plurality of teeth having a first end and a second end, said first end being attached to said base such that said first ends of adjacent said teeth form a V-shaped groove therebetween.

8. A clearing device for clearing grilles covering water intake ports on watercraft, said clearing device comprising:

at least one scraper comprising a base having a hole therethrough, a plurality of teeth extending outwardly from said base, a post having a bore therethrough attached to said base such that said bore is aligned in communication with said hole in said base; and a line passing through said bore of said post and said hole in said base, said line extending outwardly in opposing directions from said scraper.

9. A clearing device as in claim 8 wherein said teeth of said plurality of teeth are V-shaped, each tooth of said plurality of teeth having a first end and a second end, said first end being attached to said base portion such that said first ends of adjacent said teeth form a V-shaped groove therebetween and said second end of each said tooth extends outwardly from said base.

10. A clearing device as in claim 8 wherein said at least one scraper comprises a first and a second scraper, said second scraper being attached to said line such that said teeth of said scrapers extend toward one another, and said second scraper is spaced apart from said first scraper.

11. A clearing device for clearing grilles covering water intake ports on watercraft, said clearing device comprising:

a first and a second scraper, each comprising a base portion and a plurality of teeth extending outwardly therefrom, said teeth being V-shaped, each tooth of said plurality of teeth having a first end and a second end, said first end being attached to said base such that said first ends of adjacent said teeth form a V-shaped groove therebetween; and a line attached to said first and second scrapers such that when said line is straight said teeth of said scrapers extend toward one another and said first and second scrapers are spaced apart from one another, said line extending outwardly from said first scraper in a direction opposed to said second scraper and said line extending outwardly from said second scraper in a direction opposed to said first scrapper.

12. A clearing device as in claim 11 further comprising a pair of weights, one of said pair of weights being attached to said line adjacent said base portion of each said scraper.

* * * * *